United States Patent [19]

Krantz

[11] Patent Number: 4,493,859

[45] Date of Patent: Jan. 15, 1985

[54] METHOD FOR MARKING HOT PIPE

[75] Inventor: Robert J. Krantz, Hermitage, Pa.

[73] Assignee: Cyclops Corporation, Sharon, Pa.

[21] Appl. No.: 417,546

[22] Filed: Sep. 13, 1982

[51] Int. Cl.[3] ..... B05D 1/12

[52] U.S. Cl. ..... 427/193; 427/197; 118/308; 118/670

[58] Field of Search ..... 239/128, 132.3; 427/193, 189, 197, 199, 279, 424; 118/670, 308

[56] References Cited

U.S. PATENT DOCUMENTS

| | | | |
|---|---|---|---|
| 3,727,290 | 4/1973 | Schaumburg | 427/193 X |
| 3,788,874 | 1/1974 | Crandall et al. | 427/193 X |
| 4,014,286 | 3/1977 | DeZurik | 118/312 X |
| 4,065,059 | 12/1977 | Jablin | 239/128 X |
| 4,123,708 | 10/1978 | Vild et al. | 324/224 |
| 4,127,815 | 11/1978 | Vild et al. | 324/241 |

OTHER PUBLICATIONS

USS Engineers and Consultants, Inc. "Eddy-Current Inspection (ECI) System and Marking of Hot CW Pipe".

"Optimizing Eddy-Current Detection of Defects in Hot CW Pipe" By: M. L. Mester and R. L. Randall.

Binks Part Sheet 2151R for "Model 30 Automatic Glass Bead Dispensing Gun".

*Primary Examiner*—John P. McIntosh

*Attorney, Agent, or Firm*—Buell, Ziesenheim, Beck & Alstadt

[57] ABSTRACT

A method and apparatus are disclosed for marking hot workpieces which are particularly useful in marking weld defects on hot continuous welded pipe immediately after fabrication. The method involves the application of a controlled flow of glass particles to the workpiece which melt and produce a fusion coating on the workpiece. This glossy fusion coating absorbs the iron scale, penetrates to the base metal and adheres well to the hot workpiece. The coating will remain on the workpiece during cutting, sizing and initial cooling operations. Further cooling causes the coating to crack and expose the base metal leaving a bright metal mark resembling a galvanized surface. An improved glass bead dispensing gun having a modified nozzle and marking tube is used to apply the glass particles. The nozzle and marking tube enables the user to deposit an even flow of glass particles onto the workpiece and shield the gun from the hot workpiece. The gun is preferably designed so that a continuous flow of air can be provided for cooling the nozzle and marking tube and preventing clogging, during non-marking periods.

6 Claims, 4 Drawing Figures

METHOD FOR MARKING HOT PIPE

BACKGROUND OF THE INVENTION

1. Field of the Invention

The invention relates to a method and apparatus for marking pipe and other hot formed metal products while they are still hot from fabrication. The method and apparatus are particularly useful for marking detected flaws in hot metal as it emerges from the mill.

2. Description of the Prior Art

In the manufacture of steel and other metal products it is desirable to inspect for flaws and imperfections. In current manufacturing processes most inspection is done by or with the assistance of some type of detecting apparatus. Usually one or more inspections are made immediately after the final fabrication and/or at final size.

In the manufacture of continuous welded pipe the weld seam is frequently inspected by an eddy current detector positioned near the output of the forming mill. Each detection assembly has one or more detecting coils which are inductively coupled to the workpiece and which effect the flaw detection. This detection results from the capability of a detection coil to produce output signals in response to variations in eddy current flow in the workpiece. These variations are caused by flaws in the workpiece. Accordingly, variations in output signals from the detector coils which trip a pre-set alarm level activate a marking device which deposits a marker on the workpiece. Welded pipe is at a temperature ranging from 1850° F. to 2150° F. If one attempted to use conventional markers such as paint, grease or even sulfuric acid the marker would vaporize as it nears the workpiece and make no mark on the pipe. The use of various cutting or grinding tools to physically remove some metal and form a mark in the surface of the workpiece has also been proposed. But use of a grinder or cutter is impractical for a pipe mill where the workpiece to be marked is a hot steel pipe traveling at at speeds of the order of 200 to 1000 feet per minute.

Vild et al. in U.S. Pat. Nos. 4,123,708 and 4,127,815 propose the use of an aluminum powder having a melting point of approximately 1200° F. as a marker. When the powder is sprayed onto the hot workpiece which is at temperatures above the melting point of the aluminum powder, the aluminum fuses and provides a visible mark. Others have added various percentages of titanium dioxide to the aluminum powder to enhance the results.

Although the technique taught by Vild et al. will provide a visible mark on the pipe, that mark will not survive subsequent processing steps such as cooling, straightening and facing. Thus, if one uses Vild's system he must be able to remove marked pipe from the production line before subsequent processing. Many pipe mills are not equipped to remove pipe from the production line before it passes through cooling, straightening and facing operations. Hence, the Vild marking system is impractical for those plants.

SUMMARY OF THE INVENTION

I have discovered a method and apparatus for marking hot formed products such as welded pipe, bar stock and seamless tubing so that the mark will survive subsequent processing. The method and apparatus are particularly useful in marking imperfections detected by an in-line eddy current tester.

To mark the pipe I apply a controlled flow of dry porcelain enamel glass particles, generally referred to as "Frit", to the other surface of the pipe. When the glass particles strike the pipe they melt producing a dark, glossy fusion coating of molten glass on the pipe surface. This fusion coating tends to act as a solvent on the hot surface, absorbing the iron scale, penetrating to the base metal, and adhering very well to the pipe surface.

The glossy fusion coating will remain on the pipe during hot-saw cutting, water flood-type conveyor cooling and a two pass sizing operation. The mark is visible and discernible on 1700° F. to 1900° F. pipe discharged to a hot rack for crop and/or cut-to-length operations.

As the pipe is conveyed onto the cooling rack, it is air-cooled and then further cooled by water sprays to reduce the temperature to approximately 100° F. Since the contraction of the porcelain enamel glass layer is more rapid than the steel pipe, thermal shock stresses are realized which cause the fracturing of the fusion coating and loss of adhesion due to the property of glass being weak in tensile strength. The adherence failure of the coating exposes the base metal of the pipe and is indicated visually as a bright metal marking which resembles a galvanized surface.

The pipe leaving the cooling rack is conveyed through rotary straighteners and subjected to cold-working for straightening the product. The cold-water results in additional fracturing of any remaining fusion coating and tends to enhance the marking, which is highly visible and easily detected by the surface inspection personnel.

Presently available glass bead dispensing guns are unable to apply the frit onto the hot pipe so as to create a visible mark. Additionally, the prior art guns are not designed to operate in the extreme temperatures of a pipe fabrication mill. However, I have developed a dispensing gun which will apply an even flow or frit onto the workpiece without clogging. My dispensing gun's nozzle and marking tube are air cooled and direct the frit onto the hot pipe without clogging.

Other details, objects and advantages of the present invention and method of using the same shall become apparent as a description of the present preferred embodiments proceed.

DESCRIPTION OF THE PREFERRED EMBODIMENTS

Figure 1:
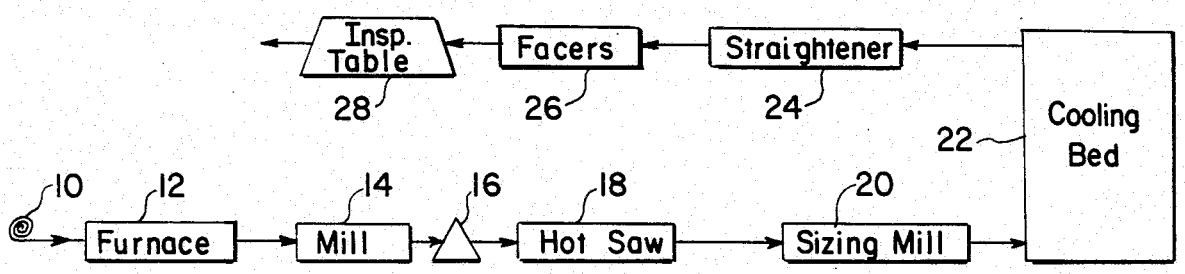
FIG. 1 is a block diagram illustrating a typical pipe plant.

Referring to FIG. 1, continuous welded pipe is made from coil stock 10 heated in furnace 12 and then hot worked into a pipe and welded in mill 14. When the welded pipe is being formed in the mill 14 its welds are inspected. If any defects are found they must be marked at 16 so that the defective pipe can be identified and removed. The pipe leaving mill is a long continuous pipe completely formed but not yet sized. Thus, the pipe must be cut into length shortly after it leaves the mill 14. Hot saw 18 is provided for cutting the hot, newly formed pipe into desired lengths. The cut lengths pass through a sizing mill 20 and onto a cooling bed 22. On the cooling bed the pipe is air-cooled and sprayed with water to reduce its temperature from the 1700° F. to 1900° F. range to approximately 100° F. The cooled pipe then passes through a straightener 24 and facers 26 and onto inspection table 28. There the pipe is checked for marked defects and defective pipe is removed. At that point the production process is complete.

In many pipe mills it is impractical to remove defective pipe from the production line before it reaches the inspection table. Thus, defects which are found at marking station 16 must be marked in a manner which will enable the inspector at station 28 to identify and remove the defective material. As can be seen from FIG. 1, the mark must survive sawing, sizing, cooling, straightening and facing operations.

The present invention provides an apparatus and method of marking hot pipe in a manner so that the mark will survive the processing steps which follow the formation. I have found that glass particles or "frit", properly applied to hot pipe will make a mark which will not only survive but which will also be enhanced by subsequent processing.

Figure 2:
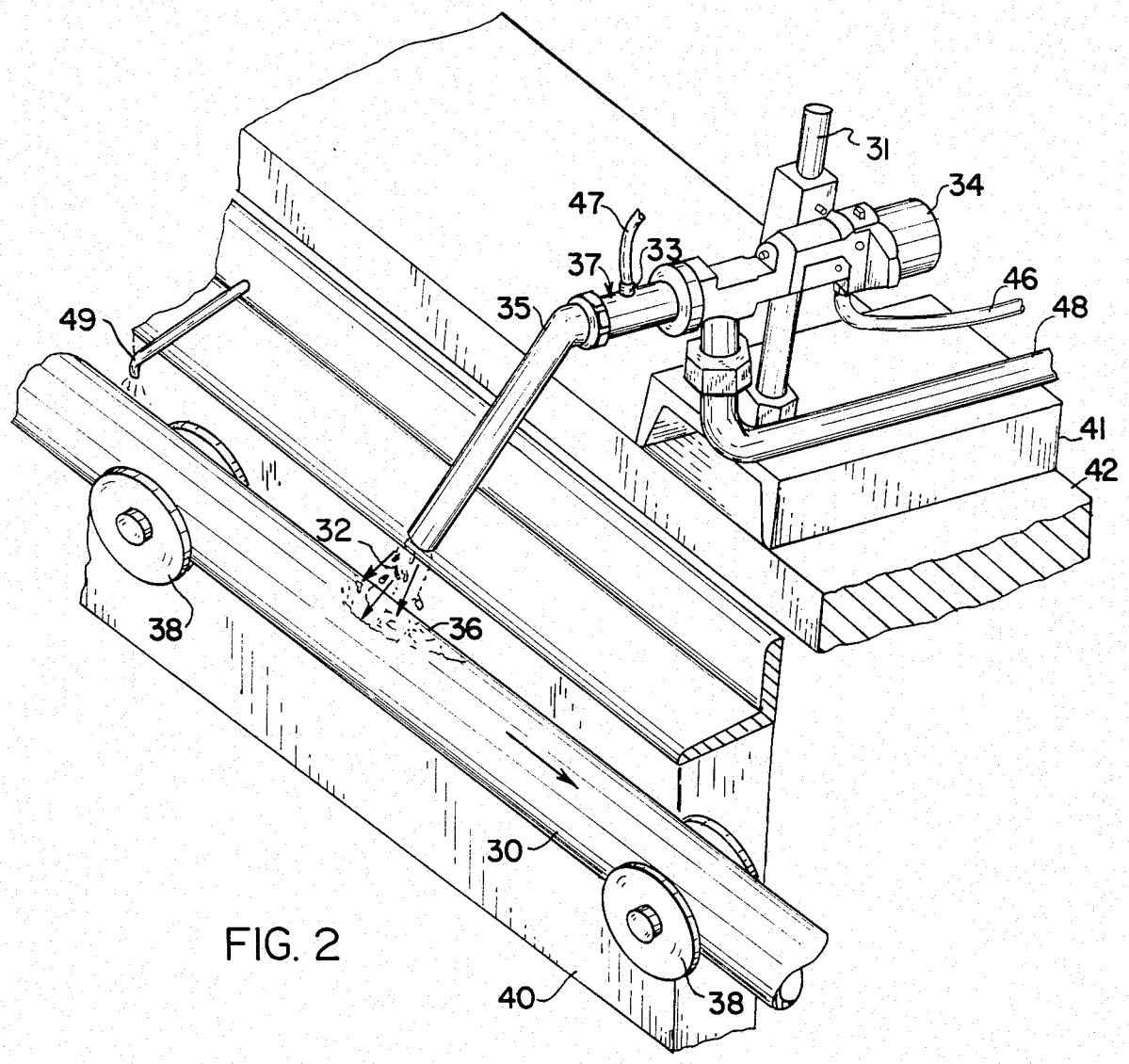
FIG. 2 is a perspective view of my marking gun positioned on a pipe production line.
Figure 3:
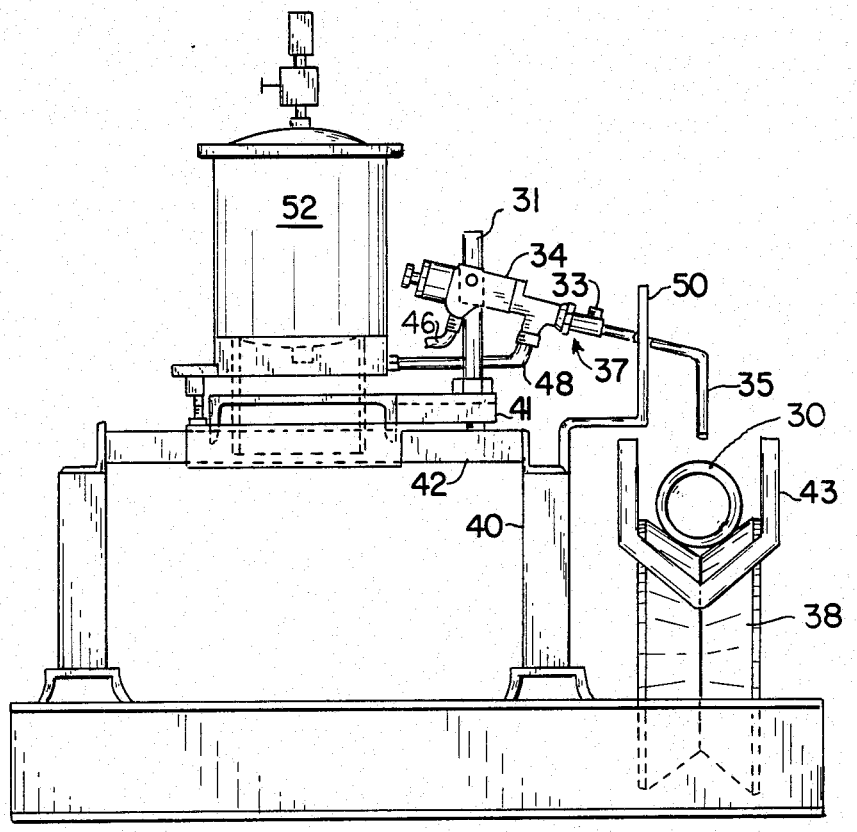
FIG. 3 is an end view of a pipe production line having my marking gun.

When the welded pipe leaves the forming and welding mill it is at a temperature ranging from 1850° F. to 2150° F. As shown in FIGS. 2 and 3, the pipe 30 is carried on rollers 38 mounted on frame 40. As it travels, water is sprayed onto the pipe from spigots 49 to cool the pipe and runout trough 43 (removed from FIG. 2 to expose pipe). When the hot pipe 30 passes a detection device in the mill its weld is tested by an eddy current tester. If a defect is found the tester will send a signal which activates the glass bead dispensing gun 34 positioned downstream from the tester (not shown). When the glass particles or frit 32 strike the hot pipe 30 they will fuse onto the pipe surface creating a fusion coating 36. The marking gun 34 is mounted onto post 31 which extends from base 41 on the mill top 42. Air supply lines 46 and 47 and frit supply line 48 are connected to the gun 34. A heat shield 50 (see FIG. 3) mounted to the frame is positioned to protect the gun 34 and supply lines 46, 47 and 48. A marking tube 35 sized to extend beyond the heat shield to above the pipe is attached to the gun through modified nozzle 37. Such an arrangement protects the gun 34 from overheating yet allows it to deposit the frit onto the pipe so it will fuse to the pipe's surface. To provide further cooling and to prevent clogging I prefer to continuously run air through the marking tube 35 during non-marking periods. Supply line 47 which attaches to nipple 33 provides air to cool the nozzle 37 and marking tube 35.

The frit which is used must not be so fine as to pack and not so large as to spill off the pipe. I prefer to use a frit wherein at least 15% is at −200 mesh, 45% is at +200 mesh 25% is at +100 mesh and 15% at +80 mesh. Ferro has developed a frit for my method now being sold as Oxidation Shield Frit SG 502 B. The frit is stored in a pressurized vessel 52 mounted on the mill frame near the gun 34.

Figure 4:
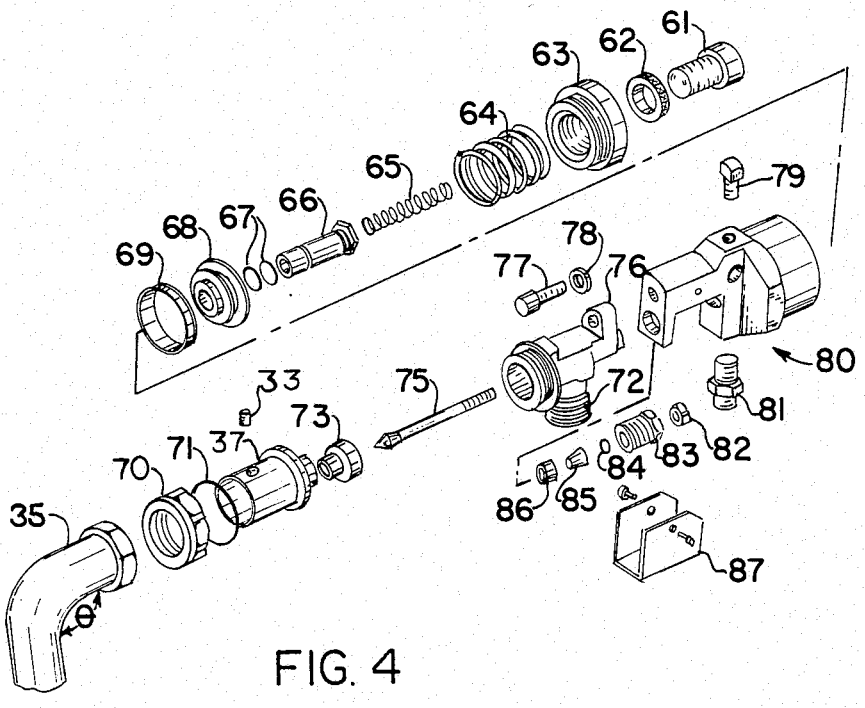
FIG. 4 is an exploded view of my marking gun.

The gun 34 is a modified Binks Model 30 Automatic glass bead dispensing gun. As shown in FIG. 4, the gun has a spring loaded control comprising a control screw 61, locknut 62, cap 63, springs 64 and 65, piston rod 66, O-rings 67, piston 68 and U-cup 69. These parts are fitted together and inserted into gun body 80 to control the gun operation. Air input nipple 81 and mounting screw 79 are attached to the gun body as shown. Also, fitted into the gun body are hex nut 82, bolt 83, O-ring 84, wiper 85 and retainer 86. Cover 87 encloses and protects this assembly. The gun head 76 contains the frit input 72 and is attached to the gun body by screw 77 with lockwasher 78. A needle valve 75 and nozzle insert 73 fit into the gun head 76. A nozzle 37 is attached to the gun head by retainer 70 with O-ring 71. Nipple 33 is attached to nozzle 37. The marking tube 35 is connected to nozzle 37. I prefer to provide an angle $\theta$ of 105° in my marking tube 35.

The L-shaped marking tube enables me to shield the gun from the hot pipe as shown in FIG. 2 and still deposit an even flow of frit onto the pipe.

While I have illustrated and described certain present preferred embodiments it is to be distinctly understood that the invention is not limited thereto but may be variously embodied within the scope of the following claims.

I claim:

1. A method of marking a hot metal workpiece using glass particles having a melting point comprising the steps of:

(a) providing a hot metal workpiece covered with mill scale and at a temperature not less than the melting point of the glass particles, (b) identifying a place on said work piece to be marked, (c) applying a controlled flow of the glass particles to the place on the hot metal workpiece, (d) allowing the particles to melt and produce a fusion coating on the place on the workpiece which coating absorbs mill scale, and (e) cooling the workpiece at least until the coating cracks and at least a portion of the coating falls off the workpiece thereby removing the mill scale from that portion of the workpiece covered by the fallen portion of the coating and leaving bare metal.

2. The method of claim 1 wherein the glass particles are of a size large enough to prevent packing and not so large as to spill off the workpiece.

3. The method of claim 1 wherein 15% of the glass particles are at −200 mesh, 45% are at +200 mesh, 25% are at +100 mesh and 15% are at +80 mesh.

4. The method of claim 1 wherein the glass particles are applied by a glass bead dispensing gun through a nozzle and marking tube attached to the gun.

5. The method of claim 4 also comprising the step of shielding the gun from the hot workpiece and air cooling the nozzle and marking tube.

6. The method of claim 4 also comprising the steps of testing the workpiece for defects and activating the gun when a defect is found so that the gun will apply the glass particles to said place on the workpiece.

* * * * *

UNITED STATES PATENT AND TRADEMARK OFFICE

CERTIFICATE OF CORRECTION

PATENT NO. : 4,493,859

DATED : January 15, 1985

INVENTOR(S) : ROBERT J. KRANTZ

It is certified that error appears in the above-identified patent and that said Letters Patent is hereby corrected as shown below:

On the title page;

Item [22], after Filed:, change "Sep." to --Sept.--.

Column 1, line 41, after traveling, delete second "at".

Column 2, line 30, change "cold-water" to --cold-working--.

Column 4, line 34, claim 1, change "work piece" to --workpiece--.

Signed and Sealed this

*Sixteenth* Day of *July 1985*

[SEAL]

*Attest:*

DONALD J. QUIGG

*Attesting Officer* *Acting Commissioner of Patents and Trademarks*